United States Patent [19]

Conner

[11] 4,086,550

[45] Apr. 25, 1978

[54] RELAY

[75] Inventor: Gary L. Conner, Cedar Springs, Mich.

[73] Assignee: U.S. Engineering Corporation, Grand Rapids, Mich.

[21] Appl. No.: 732,918

[22] Filed: Oct. 15, 1976

[51] Int. Cl.[2] ..... H01H 45/02

[52] U.S. Cl. ..... 335/132; 335/202

[58] Field of Search ..... 335/132, 202, 106, 127, 335/197

[56] References Cited

U.S. PATENT DOCUMENTS

| | | | |
|---|---|---|---|
| 3,469,215 | 9/1969 | Brovedan | 335/132 |
| 3,681,722 | 8/1972 | Johnsen et al. | 335/202 |
| 3,893,194 | 7/1975 | Hayden et al. | 335/202 |
| 4,032,869 | 6/1977 | Dietrich et al. | 335/132 |

*Primary Examiner*—Harold Broome

*Attorney, Agent, or Firm*—Price, Heneveld, Huizenga & Cooper

[57] ABSTRACT

A double pole, double throw, relay includes a pair of molded plastic subassemblies which snap together for assembly. A first subassembly has molded integral therewith a first set of fixed contacts and a pair of solenoid winding bobbins. The second molded subassembly includes a base portion and an upstanding wall portion. Embedded in and extending through the base portion are a plurality of external terminal connectors. A second set of fixed contacts are supported by the upstanding wall portion. A movable contact support plate carrying a pair of center contacts is positioned between the fixed contact sets and is operatively connected to the plunger of the solenoid. A latch arrangement is supported by the upstanding wall portion of the second subassembly and operatively engages the movable support plate to positively retain the center contacts in engagement with either the first or the second fixed contacts.

20 Claims, 10 Drawing Figures

RELAY

BACKGROUND OF THE INVENTION

This invention relates to electromagnetic relays and more particularly to a unique modular relay.

In a wide variety of applications, a need exists for a compact, subminiature double pole, double throw relay wherein the center contacts are positively latched in one of two positions upon de-energization of the solenoid. For example, in the area of automatic sequence control systems it is highly desirable to maintain the movable pair of relay contacts or terminals connected to either of the two other pairs of terminals upon de-energization of the solenoid windings. If a positive latching arrangement is not employed, the position of the movable contacts may undesirably change upon system shut-down. Also, various safety control systems are presently being employed with industrial machinery which will effectuate shut-down upon occurrence of a fault in the equipment. Forexample, safety monitor circuits are being employed to sense slipping of power press brakes.

Heretofore, solenoid operated relays have been employed to effectuate equipment shut-down upon the occurrence of a fault condition in the brake. Some of these brake monitor systems have permitted reuse of the equipment when the operator merely recycles the main power switch. In order to prevent such unsafe operation, a pair of single throw relays have been interconnected to prevent reoperation of the press. This arrangement requires that corrective measures be taken beyond the mere cycling of the power supply. This solution to the problem is costly since it requires the use of two relays. Also, the space requirements for the monitoring system are substantially increased. No known double pole, double throw, latched relay is available which possesses the unique qualities such as size, cost and amperage rating necessary for these applications.

Heretofore, various forms of latched relays have been proposed. The majority of these relays employ a permanent magnet arrangement to positively retain the movable contact assembly in engagement with one of the pair of fixed terminals. Due to the structural arrangement of these relay assemblies, they have been relatively expensive to manufacture. Latched relays having a sufficient amperage rating for use in the wide variety of control systems of the type discussed above have been relatively bulky in size and therefore require substantial mounting space.

A need, therefore, exists for a relatively simple, easily manufactured relay assembly of subminiature size having sufficient amperage rating to be employed in a wide variety of sequence control systems or safety control systems. Preferably, such a relay would take the form of a double pole, double throw, latched, two positioned, double solenoid relay which requires positive actuation to engage the movable contacts with either of two other pairs of contacts.

SUMMARY OF THE INVENTION

In accordance with the present invention, a unique, easily manufactured, solenoid actuated relay assembly is provided whereby the problems heretofore experienced are substantially alleviated. Essentially, the relay includes a pair of molded, single piece subassemblies. One of the subassemblies supports a first fixed contact and further defines a winding bobbin for supporting the windings of a solenoid. The second subassembly includes a base portion and an upstanding wall portion. A plurality of external connector terminals are imbedded within and extend through the base portion of the second subassembly. Further, a second fixed contact is supported by the upstanding wall portion. The second molded subassembly positively receives the first subassembly so that the first and second fixed contacts are positioned in a spaced vertical relationship. A movable support plate carries a center contact positioned between the first and second fixed contacts.

A plunger having a ferro-magnetic core is positioned within the winding bobbin of the first subassembly. The plunger operably engages the movable contact support plate. Provision is made for positively latching or holding the center contact in engagement with one of the fixed contacts. When the solenoid winding is energized, the center contact is snapped into engagement with the other of the fixed contacts.

DETAILED DESCRIPTION OF THE PREFERRED EMBODIMENT

Figure 1:
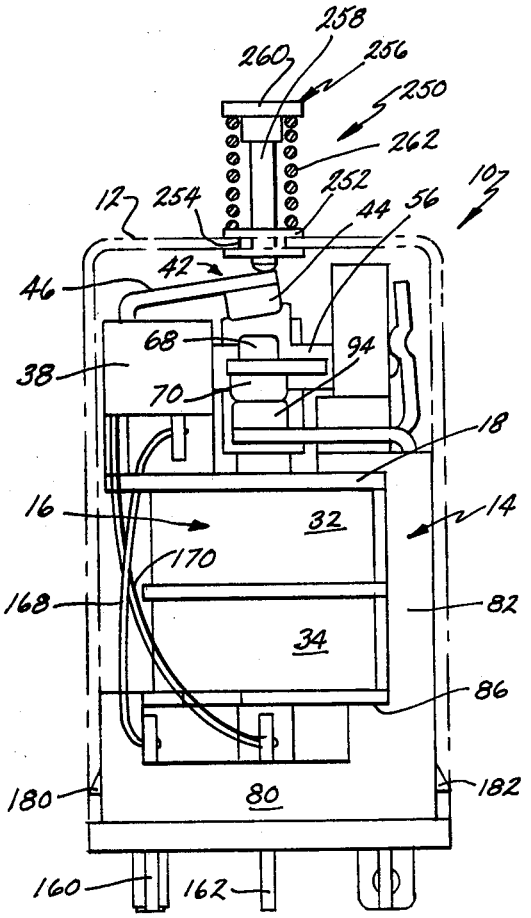
FIG. 1 is a side, elevational view of a relay assembly in accordance with the present invention.

A double pole, double throw, solenoid actuated relay in accordance with the present invention is illustrated in the drawings and generally designated 10. The relay assembly 10 is of a modular construction which increases the ease of assembly and further decreases the costs of manufacturer. The assembly includes a transparent, cube-shaped plastic housing or cover 12. The housing 12 is secured to a terminal and connector subassembly generally designated 14. The termminal and connector subassembly 14 supports and is connected to a terminal and solenoid subassembly generally designated 16.

Figure 3:
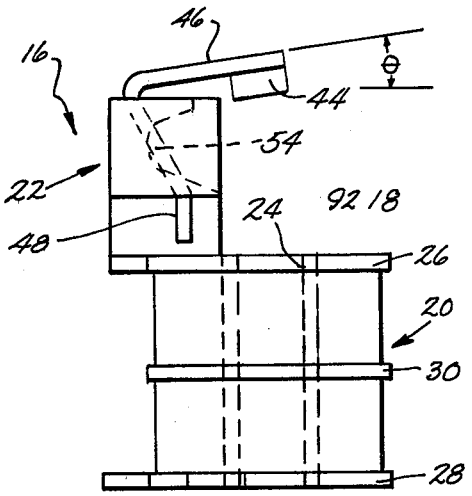
FIG. 3 is a side, elevational view of the terminal and solenoid subassembly incorporated in the relay assembly.
Figure 4:
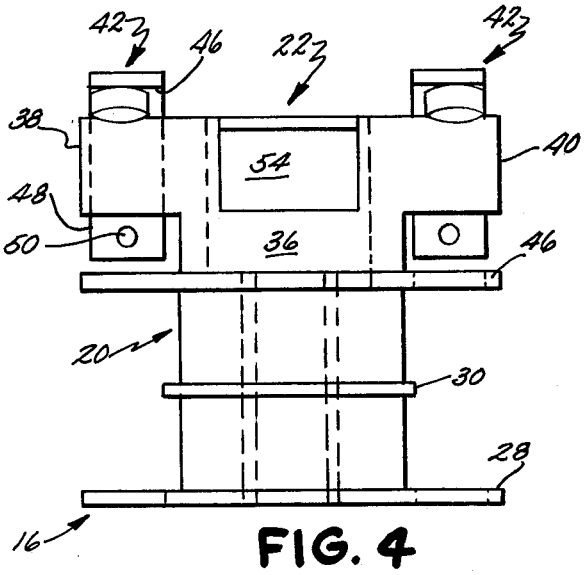
FIG. 4 is a front, elevational view of the subassembly of FIG. 3.

As best seen in FIGS. 1, 3 and 4, the terminal and solenoid subassembly 16 includes a molded, one-piece member 18 having a bobbin 20 and a fixed terminal support 22. The bobbin 20 is a generally spool-shaped structure including a central tubular portion 24, an upper peripheral flange 26, a lower peripheral flange 28 and an intermediate peripheral flange 30. The bobbin 20, therefore, provides support for a pair of solenoid windings 32, 34.

The terminal support 22 is a generally T-shaped member including a central body 36 and outwardly extending arms 38, 40 (FIG. 4). A pair of relay terminals, each designated 42 are supported on the respective arms 38, 40. Each relay terminal 42 includes a contact 44 and a bent, generally V-shaped (FIG. 3) strip-like terminal connector having leg portions 46, 48. The contact 44 is secured adjacent one end of the leg 46. Each leg 48 extends through and is imbedded within its respective support arms 38, 40. An aperture 50 provides a convenient point for soldering or otherwise connecting an electrical wire between the terminal and an external terminal connector as will be more fully described below. The contacts, terminal connectors, solenoid coils and terminals are made of electrically conductive material, typically copper or an alloy thereof. The remaining elements of the relay assembly are injection molded of an insulative thermoplastic material such as DELRIN, polyvinyl chloride (PVC) or other suitable material.

Figure 2:
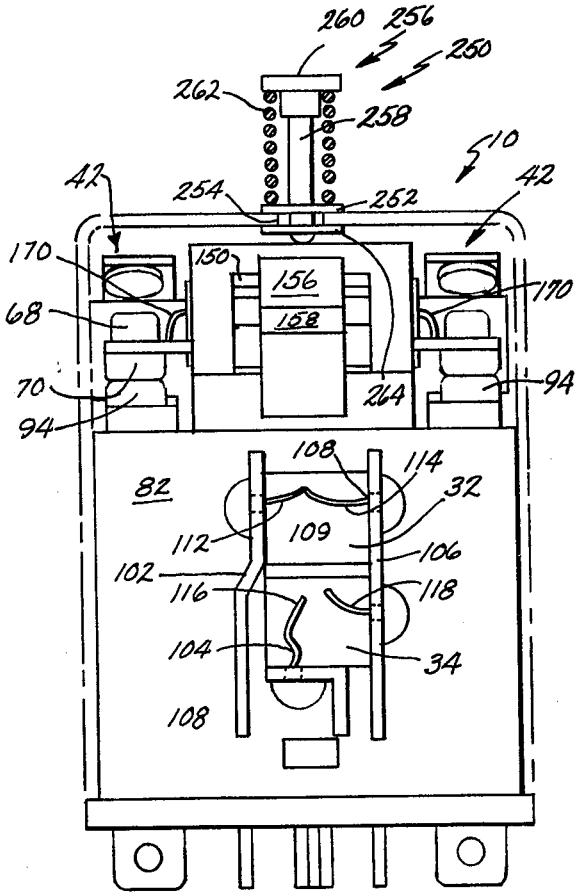
FIG. 2 is a front, elevational view of the assembly of FIG. 1.
Figure 6:
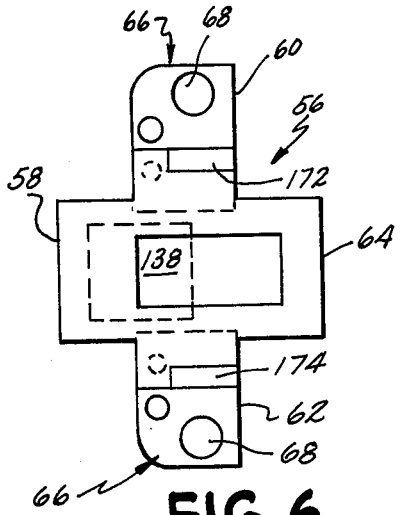
FIG. 6 is a plan view of the subassembly of FIG. 5.
Figure 5:
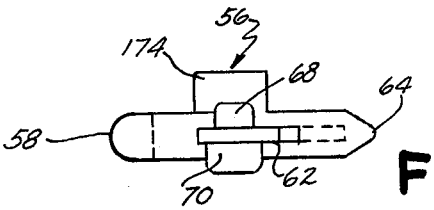
FIG. 5 is a side, elevational view of the center terminal subassembly.

The central body 36 defines a groove or recess 54 which receives a transverse edge of a center terminal support plate 56. As best seen in FIGS. 5 and 6, the center terminal support plate 56 is preferably a molded item and includes a rounded, transverse edge 58, a pair of oppositely disposed outwardly directed wing structures 60, 62 and a forwardly positioned, generally V-shaped transverse or detent edge 64. Molded integral with each wing structure 60, 62, are center terminals 66 having upper and lower contacts 68, 70 (FIG. 5). As best seen in FIGS. 1 and 2, the center terminal assembly including the support plate 56 is positioned above the solenoid windings. The rounded edge 58 is received within the groove 54 of the terminal and solenoid subassembly. The support plate, therefore, pivots about the groove or recess 54.

Figure 9:
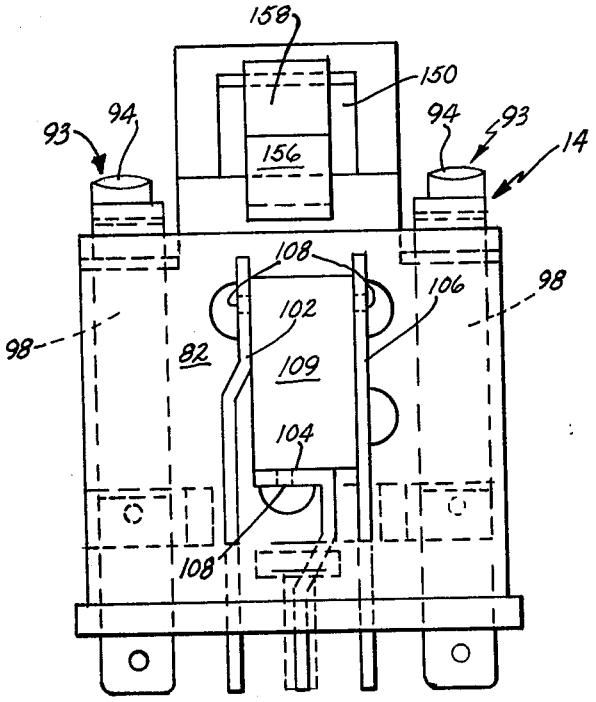
FIG. 9 is a rear, elevational view of the subassembly of FIG. 8.
Figure 10:
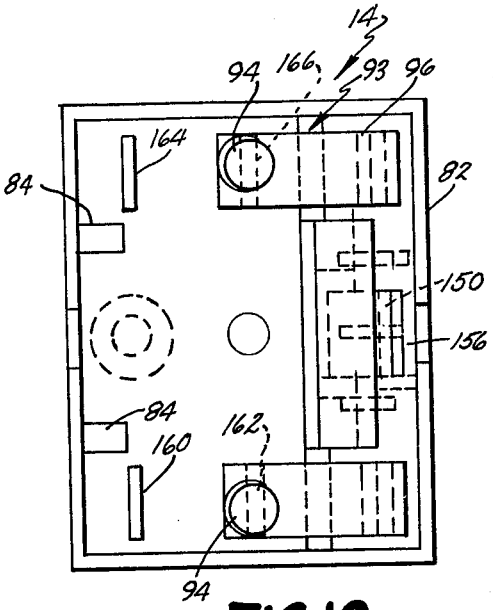
FIG. 10 is a plan view of the subassembly of FIGS. 8 and 9.
Figure 8:
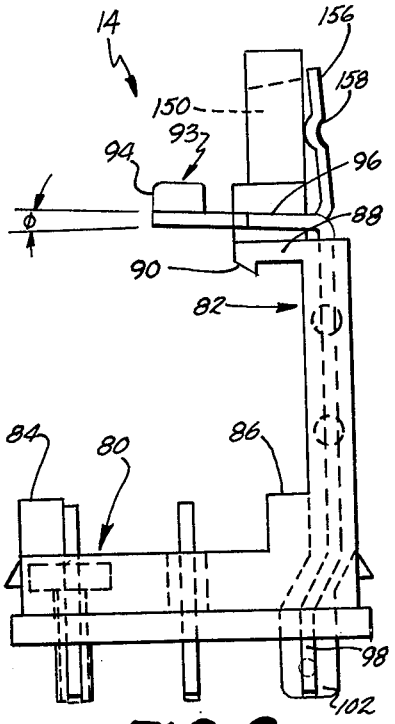
FIG. 8 is a side, elevational view of the terminal and connector subassembly.

As best seen in FIGS. 8, 9 and 10, the terminal and connector subassembly 14 includes a base 80 and an upstanding side wall 82. The base 80 has a step-like configuration in crosssection. The base includes a pair of upstanding support columns 84 and a ledge or shoulder 86 for supporting the lower flange 28 of the terminal and solenoid subassembly.

The upstanding wall 82 includes an inwardly directed, generally horizontal flange 88. Extending downwardly from the lateral edge of the flange 88 is a generally ramp-shaped or inclined detent 90. The detent 90 engages an aperture 92 formed in the upper peripheral flange 26 of bobbin 20. As a result, the plastic subassemblies 14, 16 may be interconnected or snapped together for assembly purposes.

A pair of lower, fixed relay terminals 93 are supported by the upstanding wall 82 of the terminal and connector subassembly. Each terminal 93 includes a contact surface 94 and an integral, generally L-shaped strip-like terminal connector 96. The leg 98 of the terminal connector 96 is imbedded within and extends downwardly through the upstanding wall 82 and the base 80 of the subassembly 14. Also, as best seen in FIGS. 2 and 9, three external terminal connector strips 102, 104, and 106 extend through the base 80 and upwardly through the wall 82. Each terminal connector includes a soldering point 108.

The wall 82 is formed with an aperture 109 extending longitudinally through its central portion. The terminal ends of the connector strips 102, 104, and 106 are positioned within this aperture. As best seen in FIG. 2, the ends 112, 114 of the solenoid winding 32 are soldered or otherwise suitably secured to the terminals 102, 106, respectively. The ends 116, 118 of the solenoid winding 34 are connected to the terminals 104, 106, respectively. Therefore, the connector terminal 106 serves as a common ground for each of the solenoid windings. The terminal 102 serves as the input for the solenoid 32 and the terminal 104 serves as the input for the solenoid 34.

Figure 7:
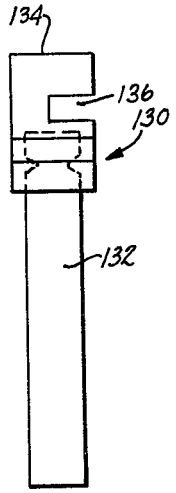
FIG. 7 is a side, elevational view of the plunger subassembly.

A plunger assembly 130, shown in FIG. 7, includes a core 132 of iron, steel or other magnetically actuatable material and a molded plastic member 134 dimensioned to fit through an aperture 138 formed in the central body portion of the center terminal support plate 56. The plate 56 is received within and engaged by the notch 136. As a result, movement of the plunger 130 upon activation of either solenoid 32 or solenoid 34 results in pivotal movement or shifting of the center terminal support plate from a first position wherein the center contacts 70 engage the set of fixed terminals mounted on the subassembly 14 to a second position wherein the contacts 68 engage the terminal contacts 42 of the upper contacts set.

As best seen in FIG. 3, each of the upper fixed terminals 46 are positioned at an angle $\theta$ from the horizontal. As seen in FIG. 8, each of the lower fixed terminals 93 are angled upwardly from the horizontal at an angle $\phi$. The amount of plunger travel and, therefore, the rotational angle through which the pivot support plate 56 travels, is selected so that the fixed terminals are deflected upon contact by the center terminals. The deflection should be sufficient to ensure proper, flush engagement between the contact surfaces of the respective terminals. This arrangement also results in a wiping action which aids in keeping the contact surfaces clean. In the preferred form, angle $\theta$ would be equal to about 8° and angle $\phi$ would be equal to about 2°. The angle through which the center terminals rotate would be selected so that approximately 2° deflection of the fixed terminals occurs upon actuation of the particular solenoid.

As best seen in FIGS. 1, 2 and 10, an aperture 152 is formed in the upstanding side wall 82 adjacent the center terminal support plate 56. The support plate 56 is dimensioned so that the V-shaped transverse edge 64 extends through the aperture 152. Mounted opposite the lateral edge 64 and imbedded in the wall 82 is an upstanding detent spring 156. The detent spring is positioned so as to be biased against the upper area of the wall 82. Further, spring 156 is formed with an inwardly directed depression or transversely extending ridge 158 positioned substantially in the center of the aperture 152. As best seen in FIG. 1, when the center terminal assembly is in its first position, the detent ridge 158 engages the upper surface of the V-shaped transverse edge 64 of the center terminal subassembly. Therefore, the center terminals are positively latched in this position. Upon actuation of one of the solenoids, a sufficient voltage or current level must be reached to overcome the frictional force exerted on the center terminal support plate by the leaf spring detent 156. Once this threshhold value is reached, the center terminal plate will snap rapidly upwardly and move into contact with the upper terminals 42. Once at this upper or second position, the detent ridge 158 of the spring 156 positively latches the center terminals. As a result, the solenoid may be deactivated without breaking contact of the center terminals with the upper fixed terminals. As the latch spring 156 is deflected away from the support plate 56, the resistance to movement, exerted on the plate rapidly decreases. The resulting snap action reduces arcing between the contact surfaces and thereby increases terminal life and reliability.

A plurality of strip-like external terminal connectors 160, 162, 164, and 166 extend upwardly through the base 80 of the terminal and connector subassembly. As best seen in FIGS. 1 and 10, terminal strips 160, 164 are connected by suitable wiring 168 to the upper, fixed relay terminals. The terminal connectors 162, 166 are electrically connected to the center terminals 66 by a suitable length of wiring 170. As best seen in FIGS. 5 and 6, the molded center terminal support plate 56 is formed with upwardly extending guide blocks 172, 174. The wires 170 connecting the contact sets 68, 70 to their respective output or input terminals 162, 166 is passed around these blocks 172, 174. This arrangement ensures that the wires when connected to the contact sets are positioned within the confines of the main body portion of the carrier plate 56. Thus, the wires are prevented from shifting to a position where they would interfere with the engagement of the terminal sets.

The subassemblies 14, 16 are easily molded with the respective terminal sets positioned therein. A suitable thermoplastic or thermosetting material is then injected into the mold. In this way, each subassembly is formed with the terminal sets and external terminal connectors as integral parts thereof. Next, the insulated wire which forms the solenoids 32, 34 are wound around the respective bobbins. The plunger assembly 130 is then inserted in the center tubular portion of the bobbin and the center contact assembly plate is positioned on and engaged by the plunger. The subassemblies 14, 16 are then snapped together so that the upper and lower terminal sets are in a spaced vertical relationship with the center terminal set positioned in between. Next, the input and output terminal strips are connected to the respective relay terminal sets with a minimum of soldering. Since the upstanding wall 82 of subassembly 14 is provided with an aperture, access is easily gained to the terminals 102, 104, and 106 for connecting the solenoid windings. Finally, the plastic cover 12 is snapped over the relay and engaged by outwardly extending ramp-like detents 180, 182. It is preferred that a fairly rigid, creep resistant material be employed in forming the sub-assemblies 14, 16 and 56. One such material which is suitable for this application is that sold under the trademark "DELRIN" and manufactured by E. I. duPont. The terminals and strip-like connectors are standard commercially available items which are easily bent into the desired shapes.

A manual reset means 250 may also be included for shifting the movable contacts 68 from engagement with contacts 42 to a position engaging contacts 93 (FIGS. 1 and 2). The reset means includes a plastic grommet-like guide 252 disposed in an aperture 254 formed centrally in the top wall of housing 12. A finger actuable plunger 256 having a stem 258 and a top button 260 rides within the guide 252. A coil spring 262 is disposed between guide 252 and the undersurface of button 260. The spring 262 biases the plunger 256 to an inoperative position wherein a stop 264 at the end of stem 258 contacts the inner surface of the top wall of the housing.

In use, an operator need merely push the plunger 256 down against the bias of spring 262. The end of the stem 258 will contact the top of solenoid plunger 130 and shift the movable contacts 68 to a reset position engaging contacts 93.

The modular terminal and solenoid subassembly and terminal and connector subassembly arrangement result in a relay which may be easily manufactured from molded plastic and which will snap-lock together with a minimum of soldering. By employing a pair of solenoids and a detent leaf spring, the terminal sets are positively latched and will be retained in position upon de-energization of the solenoid. As a result, the relay may function as a memory unit in a control system which would not be "erased" upon a shut-down of the power source. Further, the plunger provides positive switching between the two contact positions and when coupled with the detent action of the leaf spring, a snap action type switching arrangement is provided. This rapid switching or snapping between the first and second positions reduces the amount of contact arcing and, therefore, greatly increases the life of the contact surfaces.

Various modifications will undoubtedly become apparent to those of ordinary skill in the art without departing from the scope of the present invention. For example, only a single solenoid winding could be provided and the solenoid plunger could be spring loaded to one position. The single solenoid would then act to pull the plunger and the center terminal assembly to the second position. The advantage of positively retaining the position of the center terminals upon deactivation of the solenoid would not, however, be retained. The advantages of the modular construction and the snap action switching would, however, still be present. Therefore, the above description should be considered as that of the preferred embodiment only. The true spirit and scope of the present invention will be determined by references to the appended claims.

The emodiments of the invention in which an exclusive property or privilege is claimed are defined as follows:

1. A modular constructed, solenoid actuated relay, comprising:

a terminal and solenoid module including a molded, plastic member defining a bobbin portion, a fixed upper relay terminal molded integral with said member and a solenoid winding supported on said bobbin portion;

a terminal and connector module snap-locked to said terminal and solenoid module, said terminal and connector module including a molded plastic member and a fixed lower relay terminal molded integral with said member;

a center terminal subassembly positioned between said upper and lower terminals and including a molded plastic carrier plate and a center terminal molded integral with said plate; and a plunger subassembly connected to said carrier plate and including a core positioned within said bobbin portion of said terminal and solenoid module.

2. A modular constructed, solenoid actuated relay as defined by claim 1 further including means mounted on one of said modules for engaging said molded plastic carrier plate whereby movement of said plunger is resisted by said means upon activation of said solenoid winding and upon attainment of a threshhold level, the resistance is rapidly decreased and said center terminal assembly snaps into engagement with one of said fixed relay terminals.

3. A modular constructed, solenoid actuated relay as defined by claim 2 wherein said bobbin portion further supports a second solenoid winding oppositely wound from said solenoid winding whereby activation of one of said windings is necessary to shift said center terminal and said engaging means positively retains said center terminal in said shifted position.

4. A modular constructed, solenoid actuated relay as defined by claim 3 further comprising:

another fixed, upper relay terminal molded integral with said terminal and solenoid module member;

another fixed lower relay terminal molded integral with said teminal and connector module member; and another center terminal molded integral with said plate, said center terminals positioned between said upper and lower fixed terminals.

5. A modular constructed solenoid actuated relay as defined by claim 4 wherein said engaging means comprises a leaf spring having a transverse detent ridge and which is secured to said terminal and connector module member, said leaf spring being biased against and engaging said carrier plate whereby upon activation of said solenoid windings said center terminal will snap into engagement with one of said fixed terminals and remain in engagement therewith until the other of said solenoid windings is activated.

6. A modular constructed solenoid actuated relay as defined by claim 3 wherein said engaging means comprises a leaf spring having a transverse detent ridge and which is secured to said terminal and connector module member, said leaf spring being biased against and engaging said carrier plate whereby upon activation of said solenoid windings said center terminal will snap into engagement with one of said fixed terminals and remain in engagement therewith until the other of said solenoid windings is activated.

7. A modular constructed, solenoid actuated relay as defined by claim 6 wherein each of said upper and lower terminals comprises:

a flexible strip-like connector embedded in the respective subassembly molded plastic member; and a contact secured to one end of said strip-like connector, said contact being angled from the horizontal and wherein said plunger has a travel sufficient to deflect said strip-like connector until said fixed contacts are flush with said center terminals.

8. A modular constructed, solenoid actuated relay as defined by claim 7 wherein said upper and lower fixed contacts are deflected through an angle of about 2° upon full travel of said plunger.

9. A relay assembly, comprising:

a terminal and solenoid subassembly including a molded one-piece member including an integral bobbin portion for supporting a solenoid winding and an integral terminal support portion;

a terminal and connector subassembly including a molded support member integrally including a base portion and an integral upstanding wall portion, said terminal and solenoid subassembly being supported on said base portion;

a first set of fixed relay terminals secured to said molded one-piece member;

a second set of fixed relay terminals secured to said upstanding wall portion and positioned in spaced vertical relationship with said first set of terminals;

a plunger having a magnetically actuated core movably positioned within said bobbin portion;

a movable contact assembly including an integral support plate operatively connected to said plunger and a set of center terminals secured to said plate and positioned between said fixed terminals whereby upon energization of said solenoid said plunger will shift said support plate from a first position wherein said center terminals are in contact with one of said sets of fixed terminals to a second position wherein said center terminals are in contact with the other of said sets of fixed terminals; and latching means operatively engaging said support plate for latching said center terminals in contact with one of said sets of fixed terminals.

10. A relay assembly as defined by claim 9 wherein said first set of fixed relay terminals comprises a pair of contacts each including a strip-like terminal connector portion, said connector portion being partially embedded within said terminal support portion.

11. A relay assembly as defined by claim 10 wherein said second set of fixed relay terminals comprises a pair of contacts each including a strip-like terminal connector portion, said connector portion being partially embedded within said upstanding wall portion.

12. A relay assembly as defined by claim 11 wherein said terminal support portion defines a pivot groove for receiving a transverse edge of said one-piece support plate whereby said support plate pivots upon energization of said solenoid winding.

13. A relay assembly as defined by claim 12 wherein said bobbin portion defines a pair of concentric, vertically positioned spools and wherein said solenoid winding is supported by one of said spools and wherein said relay further includes a second solenoid winding supported on said second spool said second winding being adapted to pull said plunger in the opposite direction of said other solenoid winding.

14. A relay assembly as defined by claim 13 further including a plurality of external terminal connectors extending through said base portion of said terminal and connector subassembly, each of said external terminal connectors being electrically connected to a respective one of said fixed terminals, one of said center terminals, and one end of one of said solenoid windings.

15. A relay assembly as defined by claim 14 wherein said upstanding wall portion of said terminal and connector subassembly defines a longitudinally extending guide slot and wherein said one-piece support plate includes a transverse edge extending into said slot whereby said aperture serves as a guide.

16. A relay as defined by claim 9 wherein said latch means comprises:

a leaf spring supported by said terminal and connector subassembly support member and biased against a transverse edge of said support plate, said leaf spring including a transversely extending detent ridge, said ridge engaging said support plate to latch said center terminals in position upon deactivation of said solenoid winding and whereby upon activation of said solenoid winding said center terminals will snap to said second position.

17. A relay as defined by claim 15 wherein said latch means comprises:

a leaf spring supported by said terminal and connector subassembly support member and biased against a transverse edge of said support plate, said leaf spring including a transversely extending detent ridge, said ridge engaging said support plate to latch said center terminals in position upon deactivation of said solenoid winding and whereby upon activation of said solenoid winding said center terminals will snap to said second position.

18. A relay assembly as defined by claim 17 further including a housing having a top wall, said housing disposed over said terminal and connector subassembly and connected to said base portion thereof.

19. A relay assembly as defined by claim 18 further including a manual reset means extending through said top wall of said housing for engaging said movable contact assembly and manually shifting said movable contact assembly from contact with one of said sets of fixed terminals to the other of said sets of fixed terminals.

20. A relay assembly as defined by claim 19 wherein said top wall of said housing defines a centrally positioned aperture and wherein said manual reset means comprises:

a guide disposed in said top wall aperture;

a reset plunger including a stem slidably disposed within said guide, said reset plunger having a stop at one end within said housing and a top button at the other end; and spring means disposed between said guide and the undersurface of said top button for biasing said plunger to an inoperative position.

* * * * *